US008561531B2

(12) United States Patent
Rooth

(10) Patent No.: US 8,561,531 B2
(45) Date of Patent: Oct. 22, 2013

(54) HAND-HELD BATTERY POWERED CENTER PUNCH BAND CLAMP TOOL

(76) Inventor: Craig Joseph Rooth, Youngsville, NC (US)

( * ) Notice: Subject to any disclaimer, the term of this patent is extended or adjusted under 35 U.S.C. 154(b) by 55 days.

(21) Appl. No.: 13/222,537

(22) Filed: Aug. 31, 2011

(65) Prior Publication Data

US 2013/0047870 A1 Feb. 28, 2013

(51) Int. Cl.
*B21F 9/00* (2006.01)

(52) U.S. Cl.
USPC ..... 100/29; 100/30; 100/32; 100/33 R; 100/33 PB; 140/93.2; 140/93 A

(58) Field of Classification Search
USPC ..... 100/29, 30, 32, 33 R, 33 PB; 140/93.2, 140/93 A
See application file for complete search history.

(56) References Cited

U.S. PATENT DOCUMENTS 4,056,128 A * 11/1977 Konrad ..... 140/93.4
4,747,433 A * 5/1988 Dixon ..... 140/150
4,928,738 A 5/1990 Hinnen et al.
4,928,739 A * 5/1990 Teubert ..... 141/5
4,934,416 A * 6/1990 Tonkiss ..... 140/93.2
5,111,853 A 5/1992 Scruggs
5,123,456 A * 6/1992 Jansen ..... 140/93.4
5,129,350 A 7/1992 Marelin
5,193,592 A 3/1993 Evilsizer et al.
5,566,726 A 10/1996 Marelin
5,595,220 A * 1/1997 Leban et al. ..... 140/123.6
5,743,310 A 4/1998 Moran
6,338,375 B1 1/2002 Harada
6,546,853 B2 4/2003 Watanabe
7,143,920 B2 * 12/2006 Panasik et al. ..... 227/120
7,458,398 B2 12/2008 Hillegonds et al.
2010/0139805 A1 * 6/2010 Sledzinski ..... 140/93.2

OTHER PUBLICATIONS

Hayata Ltd. of Dallas, Texas, United States: Battery Operated Banding Tool, Model BTX6000 http://hayata.com/products/tools/pmbanding.htm.

* cited by examiner

*Primary Examiner* — Dana Ross
*Assistant Examiner* — Onekki Jolly
(74) *Attorney, Agent, or Firm* — Mark D. Bowen; Malin Haley DiMaggio & Bowen, P.A.

(57) ABSTRACT

A battery powered banding tool is adapted with a punch for use in tightening and securing center punch type band clamps. A hand-held electrically powered drill is configured for rotationally driving a band tensioner mounted thereto. The band tensioner includes a gear box, and a mount including a generally U-shaped rigid strap which engages the rear of the driving tool to secure the gear box. The gear box contains a worm gear axially coupled to the chuck for powered driven rotation thereby. The worm gear is in intermeshing relation with a winder gear disposed within the gear box and configured for rotation about an axis disposed generally perpendicular to the worm gear axis. A winder, defining a band-receiving slot, is affixed to the winder gear and rotationally driven thereby. A punch assembly, defining a band-receiving slot, is disposed in forwardly spaced aligned relation with the winder. The punch assembly includes a pivotal punch that functions to allow the user to lock a center punch band clamp by deforming the band within the confines of the band buckle upon impact.

4 Claims, 6 Drawing Sheets

HAND-HELD BATTERY POWERED CENTER PUNCH BAND CLAMP TOOL

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to tools for use with band-type clamps used for applying radial compression to one or more objects, and more particularly to a hand-held battery-powered banding tool having a center punch for use in tightening and securing center punch band clamps.

2. Description of Related Art

Band clamps are commonly used for applying radial compression to one or more objects, such as for securing bundled objects or for securing one object to another. A number of tools have been provided for tensioning band clamps. A typical center punch clamp comprises an elongate (typically metal) band having a buckle affixed to one end, and a tail end opposite the buckle end. Installation of the clamp generally involves wrapping the clamp around the object(s) to be secured, and inserting the tail end through the buckle, whereafter the band is tensioned by further drawing the band through the buckle upon application of a force. Once the band is sufficiently tensioned, it may be locked by application of a mechanical punch to deform that band within the buckle thereby locking the band to the buckle.

The background art reveals several manual and powered banding tools for use in the installation of band-type clamps. For example, U.S. Pat. No. 5,123,456, issued to Jansen, discloses a manual banding tool that includes a clamping plunger or punch which, upon manual manipulation of a lever, functions to lock the band by manual deployment of a punch to deform the band at the buckle. The device disclosed by Jansen, however, is manually operated and thus requires the user to exert tremendous force to both tighten and secure the band. Accordingly, the connection is subject to failure should the user be unable to apply sufficient force. Further, the use of a manual banding tool has been known to tier and fatigue the user, particularly, after repeated use.

As a result of the disadvantages present with manual banding tools, at least one manufacturer has developed a battery powered banding tool. Hayata Ltd., of Dallas, Tex. (www.hayata.com), manufactures a battery operated banding tool which comprises a tensioning and cutting apparatus attached to an otherwise conventional battery powered drill. The Hayata device, however, has been designed for use with a variety of band clamps, and thus is burdened by significant limitations when employed for use with center punch band clamps. One such limitation associated with the Hayata device, is its failure to provide any structure for securing the band clamp once tightened. As a result of this shortcoming, the user must employ some other means of affecting a punch so as to securely affix the buckle and band.

As a result of the limitations and shortcomings in the art, there exists a need for an improved power operated banding tool specifically adapted with a center punch for use in tightening and securing center punch band-type clamps.

BRIEF SUMMARY OF THE INVENTION

The present invention overcomes the limitations and disadvantages present in the art by providing a battery operated, hand-held banding tool having a center punch for use in tightening and securing center punch band clamps. A power operated band clamp tensioning tool in accordance with the present invention preferably comprises driving tool having a hand-held main body containing a motor and electrical power source configured for rotationally driving a chuck, and a band tensioner connected to the main body and mechanically coupled to the chuck. The band tensioner preferably includes a gear box, and a gear box mount which functions to secure the gear box to the main body in coupled relation with the chuck. In a preferred embodiment, the gear box mount includes a generally U-shaped rigid strap which engages the rear of the hand-held main body to secure the gear box. The gear box contains a worm gear axially coupled to the chuck for powered driven rotation thereby. The worm gear is in intermeshing relation with a winder gear disposed within the gear box and configured for rotation about an axis disposed generally perpendicular to the worm gear axis. A winder, defining a band-receiving slot, is affixed to the winder gear and rotationally driven thereby. A cover plate is attached to the gear box in covering relation with the gears, and defines an aperture through which the winder projects. A punch assembly, defining a band-receiving slot, is connected to the distal end of the cover plate with the slot disposed in forwardly spaced aligned relation with the winder. The punch assembly includes a pivotal punch that functions to allow the user to lock a center punch band clamp by deforming the band within the confines of the band buckle upon impact. The punch preferably includes a first end pivotally connected to the cover plate, and a second end having a first side adapted with a generally pointed tip and an opposing, generally planar second side that provides a surface for receiving an impact blow from a hammer or other blunt striking implement so as to securely lock the band clamp. The present invention thus provides an improved power operated banding tool that allows for powered tightening of a center punch band clamp, and locking of the band using an integral hammer punch.

Accordingly, it is an object of the present invention to provide power operated banding tool specifically adapted with an integral center punch for use in tightening and securing center punch band-type clamps.

Another object of the present invention is to provide such a tool that includes an integral hammer punch pivotally connected to the cover plate and adapted with a surface for receiving an impact blow from a hammer or other blunt striking implement so as to securely lock the band clamp.

These and other objects are met by the present invention which will become more apparent from the accompanying drawing and the following detailed description of the drawings and preferred embodiments.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

With reference now to the drawings, FIGS. 1-6 depict a power operated banding tool, generally referenced as 10, specifically adapted with an integral center punch for use in tightening and securing center punch band-type clamps in accordance with the present invention.

A power operated banding tool in accordance with the present invention preferably comprises a hand-held electrically powered driving tool, such as a drill, having a main body 12 including grip 12A having a trigger-type actuator 12B, a battery power source 12C, a proximal or rear end 12D, and a distal or front end 12E containing a rotatable chuck. As is known in the power tool art, the driving tool may comprise a battery powered, cordless electric drill having an internal electric motor and mechanical linkages configured for rotationally driving a chuck at the distal end 12E of main body 12.

Figure 1:
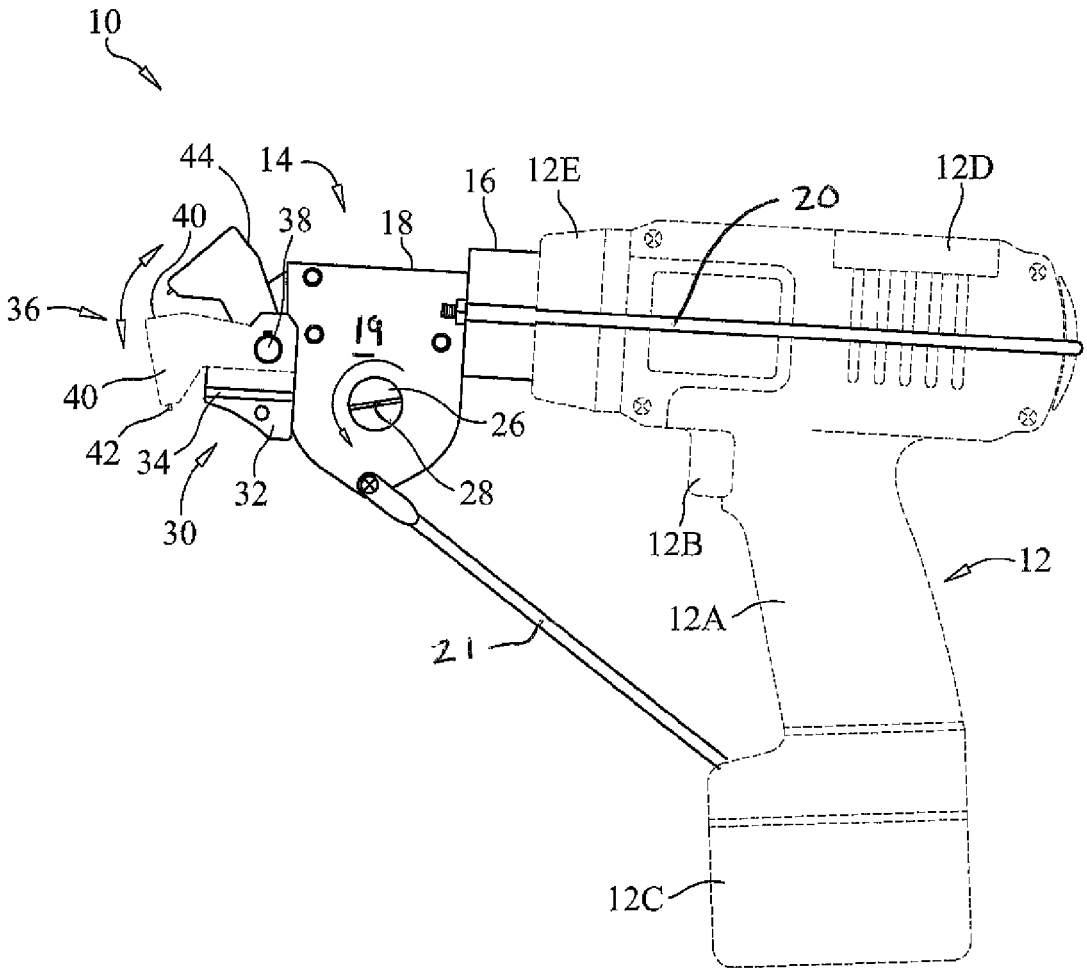
FIG. 1 is a left side view of a power operated banding tool with center punch in accordance with the present invention.
Figure 2:
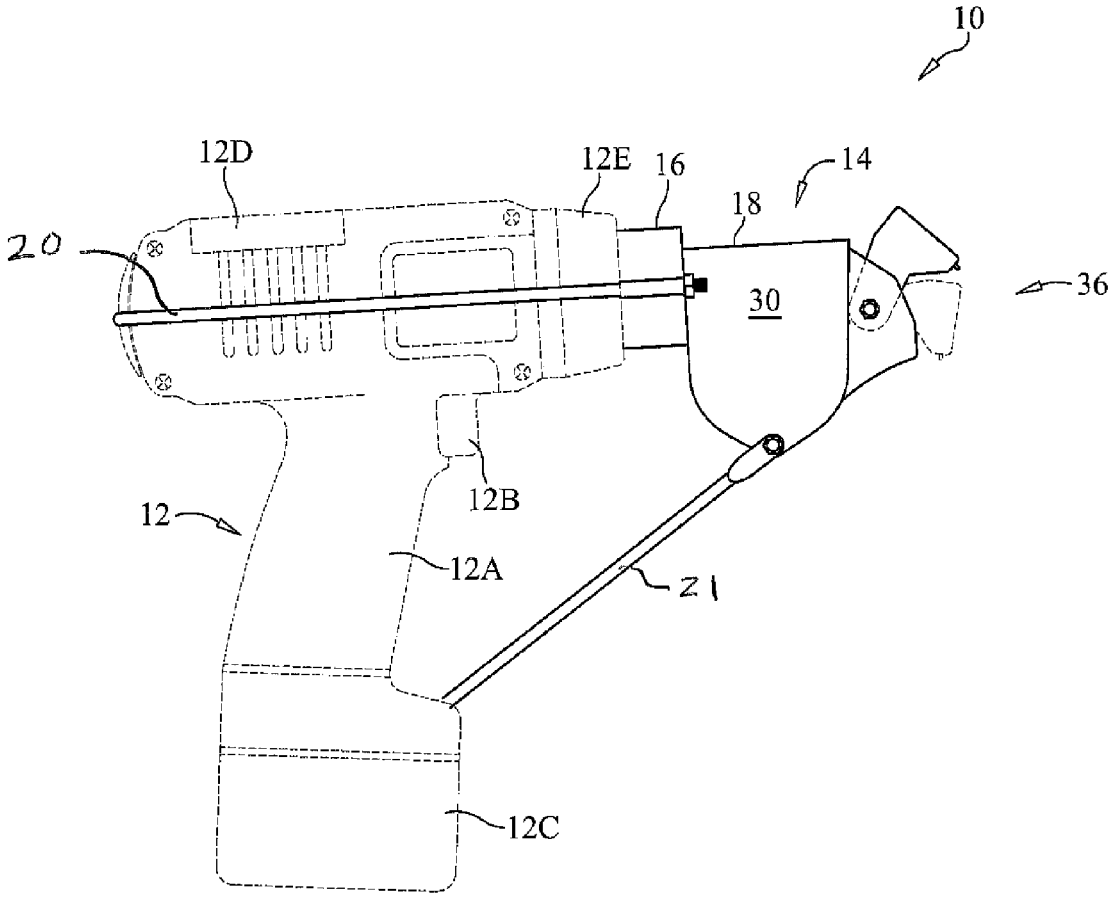
FIG. 2 is a right side view thereof.

As illustrated in FIGS. 1 and 2, a band tensioner, generally referenced as 14, is attached to the distal end 12E of main body 12 and mechanically coupled to the chuck. Band tensioner 14 preferably comprises a mount 16 and a gear box 18. Mount 16 functions to secure the gear box 18 to main body 12 in coupled relation with the chuck. In a preferred embodiment, mount 16 includes a generally U-shaped rigid strap 20 which engages the rear end 12D of the hand-held main body 12. In addition, a strut 21 anchors gear box 18 relative to the grip 12A of the hand-held main body.

Figure 6:
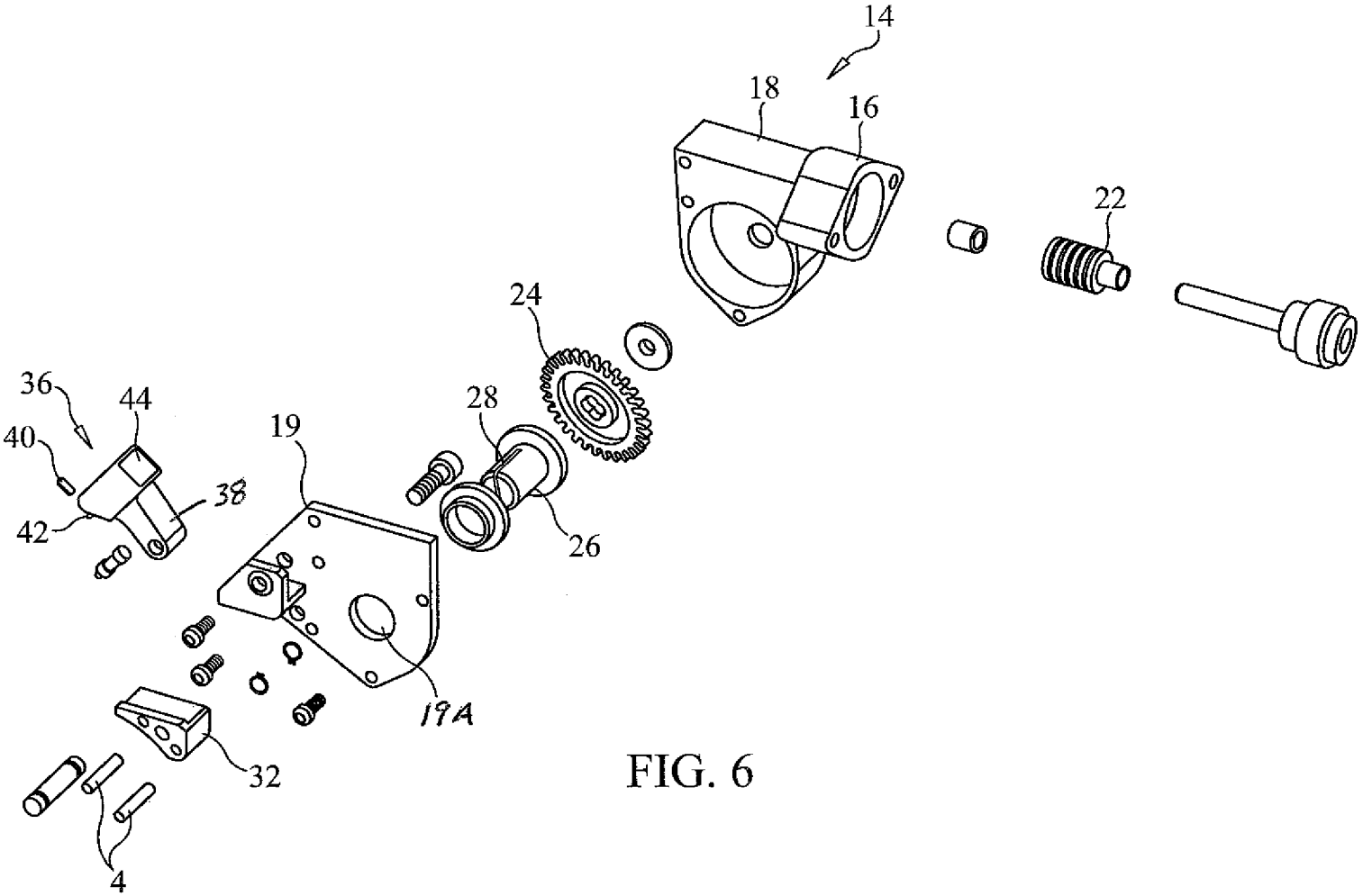
FIG. 6 is an exploded view thereof.

As best seen in FIG. 6, gear box 18 preferably contains a worm gear 22 axially coupled to the chuck for powered driven rotation thereby. Gear box 18 further includes a winder gear 24 rotationally mounted thereto in intermeshing relation with worm gear 22 and configured for rotation about an axis disposed generally perpendicular to the worm gear axis. A winder 26, defining a band-receiving slot 28, is affixed to winder gear 24 and rotationally driven thereby. A cover plate 19 is attached to gear box in covering relation with the worm gear 22 and winder gear 24, and defines an aperture 19A through which winder 26 projects.

Figure 3:
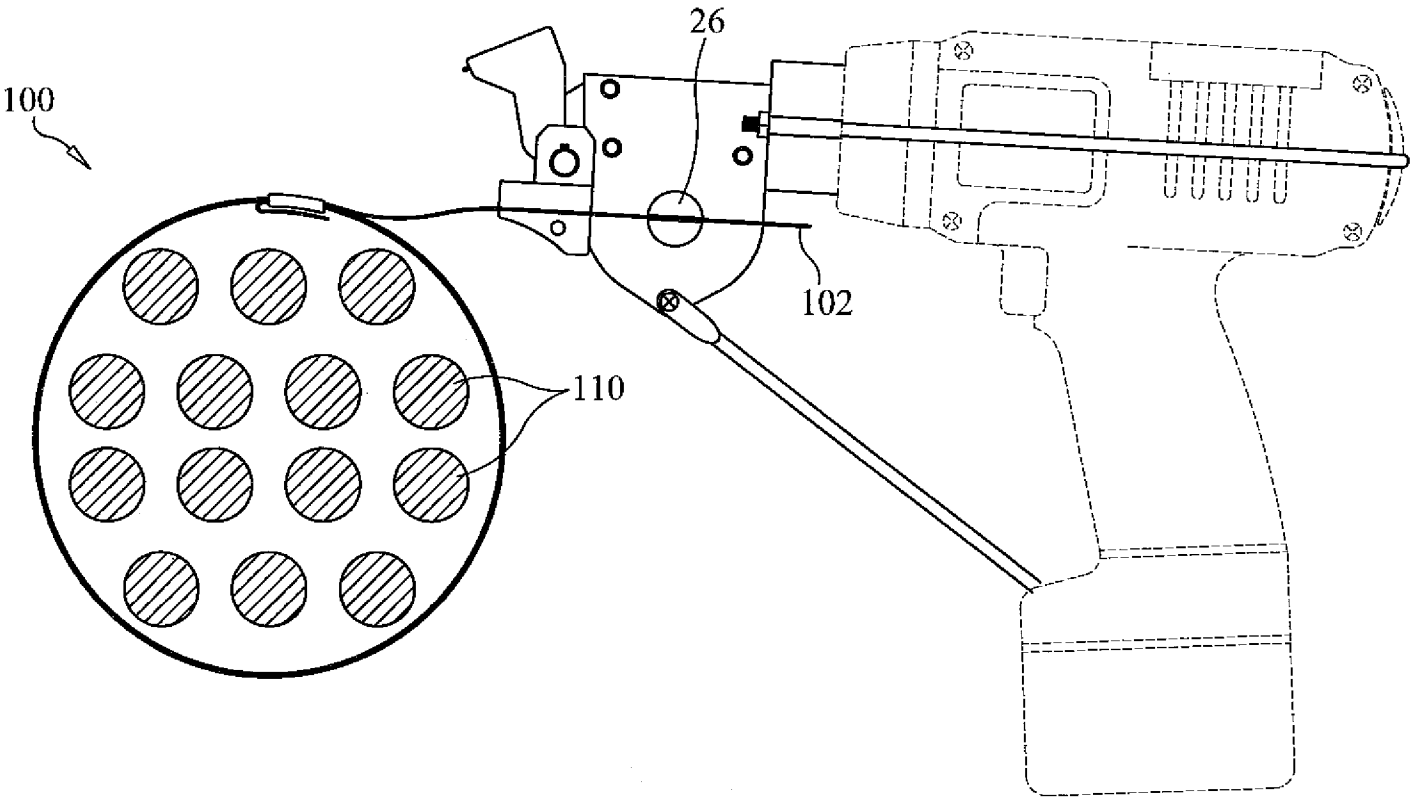
FIG. 3 is a side view illustrating the power operated band tensioning tool of the present invention in use to tension a center-punch band clamp.
Figure 5:
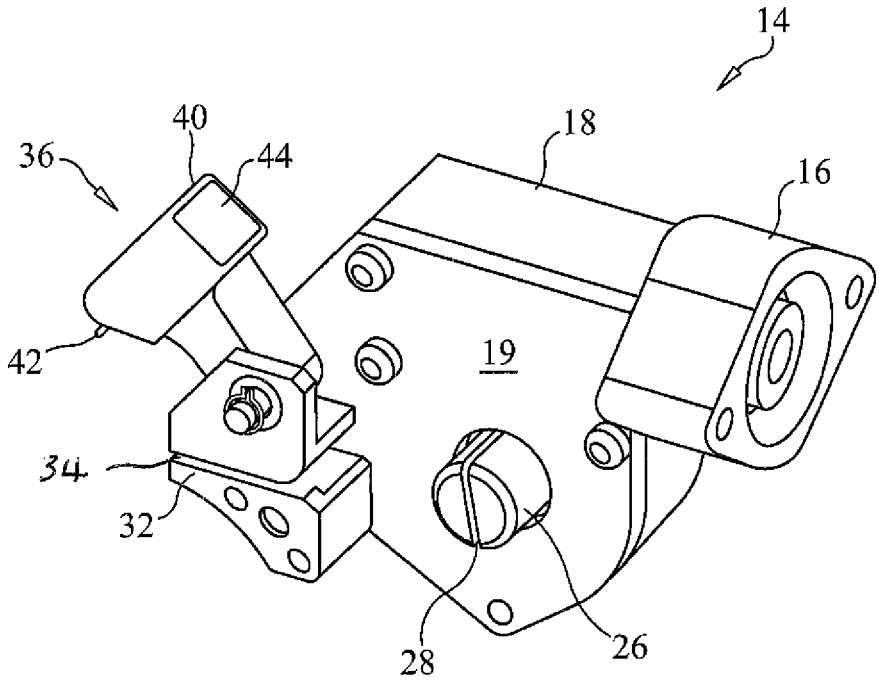
FIG. 5 is a top perspective view of a band tightening tool detached from the cordless electrically powered driving tool.

A significant aspect of the present invention relates to providing a powered band tensioning tool adapted with means for securing a center punch band clamp. In that regard, a hammer punch assembly, generally reference as 36, is affixed to the gear box structure as best seen in FIGS. 5 and 6. As seen in FIG. 1, hammer punch assembly 36 includes a lower portion 32 defining a band-receiving slot 34, and is connected to the distal end of cover plate 19 such that the slot 34 is disposed in generally aligned, forwardly spaced relation with band winder 26 and particularly slot 28, such that the tail end of a band to be tensioned may be threaded through slot 34 on the lower portion 32 of hammer punch assembly 30 as well as through slot 28 on winder 26 in preparation for tensioning as illustrated in FIG. 3. Hammer punch assembly 30 further includes a pivotally connected punch, generally referenced as 36, that functions to allow the user to lock a center punch band clamp by deforming the band within the confines of the band buckle upon impact. Punch 36 preferably includes a first end 38 pivotally connected to the cover plate 19 on gear box 14, and an opposing second end 40 having a first side adapted with a generally pointed tip 42 and an opposing second side defining a generally planar surface 44 that provides a surface for receiving an impact blow from a hammer or other blunt striking implement so as to securely lock the band clamp. As should be apparent, punch 36 is pivotally configurable between a first position wherein punch 36 is disposed generally vertically when not in use, and a second position wherein punch 36 is disposed generally horizontally with tip 42 engaging a portion of the band.

Figure 4:
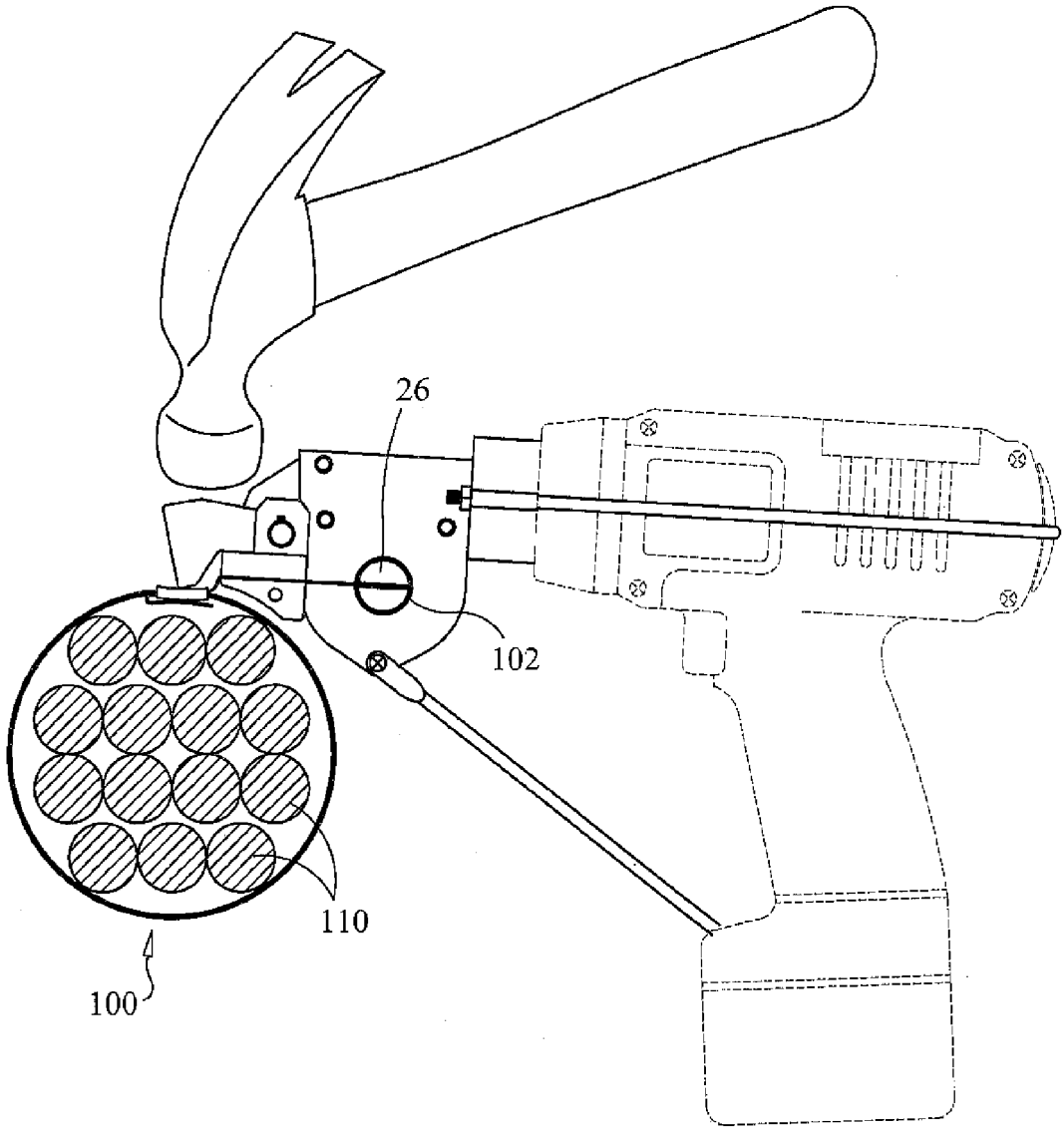
FIG. 4 is a side view illustrating the tightening and buckling of the band clamp using the center-punch.

FIGS. 3 and 4 illustrate the deployment of a battery powered, hand-held banding tool 10 having a center punch 36 for use in tightening and securing center punch band clamps in accordance with the present invention. The present invention may be employed to tension and secure a center punch band clamp to secure or bundle one or more articles by first threading the tail end 102 of a band 100 through slot 34 on the lower portion 32 of hammer punch assembly 30 as well as through slot 28 on winder 26. Next, the user activates the tool by actuation of trigger 12B on grip 12A of main body 12 thereby applying powered rotation of the chuck at the distal end 12E, which in turn drives winder 26, via worm gear 22 and winder gear 24. Rotation of winder 26 draws the tail end 102 of band 100 into wound relation about winder 26 so as to result in radial reduction of the band clamp 100 around the object(s), referenced as 110 to be secured by the clamp. Once properly tensioned, the user simply releases trigger 12B whereby rotation of winder 26 terminates. With the band clamp properly tightened, the user positions punch 36 to its second position wherein tip 42 engages that portion of the band within the buckle, and imparts an impact to the flat surface 44 so as to deform the clamp thereby locking the band with respect to the buckle. The user then snips the excess band tail portion and removes the wound band from winder 26 and discards. Accordingly, a significant aspect of the present invention involves providing a powered band tensioning tool adapted with the capability of securing the band after having been tightened by use of the integrally incorporated center punch 36.

The present invention thus provides an improved power operated banding tool that allows for powered tightening of a center punch band clamp, and locking of the band using an integral hammer punch. Providing a power operated band tensioning tool specifically adapted with an integral punch allows the user to install center punch band clamps much easier and faster than would be achievable with a manual clamp tensioning tool, and more efficiently that could be accomplished using a power band tensioning tool without an integral punch. As should be apparent the present invention provides a band tensioner that may be sold separately and subsequently attached to an electrically powered drill, or may be sold pre-installed on an electrically powered drill.

Therefore, the foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A band clamp tensioning tool, for attachment to a hand-held power tool having a main body and an electrical power source configured for rotationally driving a chuck, to tension and lock a center punch band clamp having a band and a buckle, said apparatus comprising:

a band tensioning assembly attached to the power tool;

said band tensioning assembly including a gear box and a gear box mount mechanically coupled to said chuck;

said gear box mount including a generally U-shaped rigid strap which engages a rear portion of the hand-held main body to secure the gear box;

said gear box including a worm gear axially coupled to the chuck for powered driven rotation thereby;

a winder gear in intermeshing relation with said worm gear for rotation about an axis disposed generally perpendicular to the worm gear axis;

said winder, defining a band-receiving slot;

a punch assembly, defining a slot, connected to the distal end of said gear box with the slot disposed in forwardly spaced aligned relation with said winder;

said punch assembly including a pivotal punch having a first end pivotally connected to said gear box, and a second end having a first side adapted with a generally pointed tip positioned to engage the band clamp buckle, and an opposing generally planar second side that provides a surface for receiving an impact blow from a blunt striking implement so as to securely lock the band clamp by impact of the pointed tip of said pivotal punch that deforms a portion of the band within the band buckle.

2. A band tensioning tool according to claim 1, further including a strut that anchors said gear box relative to the main body of the power tool.

3. A band clamp tensioning apparatus to tension and lock a center punch band clamp having a band and a buckle, said apparatus comprising:

a hand-held power tool having a main body and an electrical power source, said tool configured for rotationally driving a chuck disposed the distal end thereof;

a band tensioning assembly attached to said power tool;

said band tensioning assembly including a gear box, a gear box mount coupled to said gear box, and said gear box mount mechanically coupled to said chuck;

said gear box mount including a generally U-shaped rigid strap which engages a rear portion of the hand-held power tool to secure the gear box;

said gear box including a worm gear axially coupled to the chuck for powered driven rotation thereby;

a winder gear in intermeshing relation with said worm gear for rotation about an axis disposed generally perpendicular to the worm gear axis;

said winder, defining a band-receiving slot;

a punch assembly, defining a slot, connected to the distal end of said gear box with the slot disposed in forwardly spaced aligned relation with said winder;

said punch assembly including a pivotal punch having a first end pivotally connected to said gear box, and a second end having a first side adapted with a generally pointed tip and an opposing, generally planar second side that provides a surface for receiving an impact blow from a blunt striking implement, said pivotal punch disposed such that said pointed tip engages the buckle of the band clamp thereby deforming the buckle so as to securely lock the band clamp.

4. A band tensioning tool according to claim 3, further including a strut that anchors said gear box relative to the main body of said hand-held power tool.

* * * * *